US010062265B2

(12) United States Patent
Dey et al.

(10) Patent No.: US 10,062,265 B2
(45) Date of Patent: Aug. 28, 2018

(54) ADAPTIVE EXIT ARM TIMES BASED ON REAL TIME EVENTS AND HISTORICAL DATA IN A HOME SECURITY SYSTEM

(71) Applicant: Google LLC, Mountain View, CA (US)

(72) Inventors: Sourav Raj Dey, South San Francisco, CA (US); Mark Rajan Malhotra, San Mateo, CA (US); Ehsan Maani, San Jose, CA (US); Yash Modi, San Mateo, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 15/864,752

(22) Filed: Jan. 8, 2018

(65) Prior Publication Data

US 2018/0197399 A1 Jul. 12, 2018

Related U.S. Application Data

(63) Continuation of application No. 14/985,841, filed on Dec. 31, 2015, now Pat. No. 9,865,154.

(51) Int. Cl.
*G08B 23/00* (2006.01)
*G08B 25/00* (2006.01)

(52) U.S. Cl.
CPC ..... *G08B 25/008* (2013.01)

(58) Field of Classification Search
None
See application file for complete search history.

(56) References Cited

U.S. PATENT DOCUMENTS

| | | | | |
|---|---|---|---|---|
| 3,200,393 | A | 8/1965 | Worley | |
| 4,754,255 | A | 6/1988 | Sanders | |
| 5,429,399 | A | 7/1995 | Geringer | |
| 5,570,079 | A | 10/1996 | Dockery | |
| 5,801,625 | A | 9/1998 | Wang | |
| 6,462,652 | B1 | 10/2002 | McCuen | |
| 6,912,429 | B1 * | 6/2005 | Bilger | G08B 25/008 236/49.3 |
| 7,400,242 | B2 * | 7/2008 | Martin | G08B 25/008 340/506 |
| 7,403,109 | B2 * | 7/2008 | Martin | G08B 29/24 340/506 |
| 8,098,156 | B2 * | 1/2012 | Caler | G08B 25/008 340/500 |
| 2006/0192666 | A1 * | 8/2006 | Parker | G08B 25/04 340/507 |
| 2010/0045461 | A1 | 2/2010 | Caler | |
| 2012/0019353 | A1 | 1/2012 | Knasel | |
| 2012/0065844 | A1 * | 3/2012 | Metlitzky | B60R 25/10 701/45 |

* cited by examiner

*Primary Examiner* — Julie Lieu
(74) *Attorney, Agent, or Firm* — Morris & Kamlay LLP

(57) ABSTRACT

A security system includes a plurality of sensors installed at a premises to capture data from an environment in or around the premises, a memory configured to store data captured spanning at least a first period of time, and a processor configured to arm the plurality of sensors in an order determined based on a history of detected activity in the premises as indicated by the stored data.

14 Claims, 7 Drawing Sheets

610

| | Device | Event | ΔTime ($T_0$ to Last Detection) |
|---|---|---|---|
| 130 | KN THERM01 | Sound detected | 2, 3, 3, 2, 4, 3, 3 |
| 170 | LR CAM01 | Individual detected | 5, 4, 4, 6, 4, 5, 6 |
| 140 | FD ED01 | Door Open | 8, 6, 9, 7, 8, 9, 5 |
| 171 | FD ED01 | Door Closed | 9, 8, 10, 8, 11, 10, 8 |
| | DEN CAM02 | None | -- |
| | | ... | |

600

FIG. 6A

| | Device | Event | ΔTime ($T_0$ to Last Detection) |
|---|---|---|---|
| 130 | KN THERM01 | Sound detected | 2, 3, 3, 2, 14, 3, 3 |
| 170 | LR CAM01 | Individual detected | 5, 4, 4, 6, 16, 5, 6 |
| 140 | FD ED01 | Door Open | 8, 6, 9, 7, 20, 9, 5 |
| 171 | FD ED01 | Door Closed | 9, 8, 10, 8, 23, 10, 8 |
| | DEN CAM02 | Individual detected | 9 |
| | | ... | |

600

FIG. 6B

| | Device | Arm Time |
|---|---|---|
| 130 | KN THERM01 | 9 |
| 170 | LR CAM01 | 11 |
| 140 | FD ED01 | 16 |
| 171 | DEN CAM02 | 0 |
| | | ... |

700

FIG. 7A

| | Device | Arm Time |
|---|---|---|
| 130 | KN THERM01 | 19 |
| 170 | LR CAM01 | 21 |
| 140 | FD ED01 | 28 |
| 171 | DEN CAM02 | 14 |
| | | ... |

700

FIG. 7B

ADAPTIVE EXIT ARM TIMES BASED ON REAL TIME EVENTS AND HISTORICAL DATA IN A HOME SECURITY SYSTEM

BACKGROUND

Homes, offices, and other buildings may be equipped with smart networks to provide automated control of devices, appliances and systems, such as heating, ventilation, and air conditioning ("HVAC") system, lighting systems, home theater, entertainment systems, as well as security systems. A security system may include one or more sensors installed throughout a premises. The sensors may, for example, detect movement or changes in light, sound, or temperature.

Security system operational modes may include a so-called "AWAY" mode. In an AWAY mode the security system may operate under the assumption that no authorized parties are in the premises; therefore all sensors, interior and exterior, may be armed to trigger an alarm. However, when a security system is initially switched to an AWAY mode, the system may enter an "arming phase" during which none of the sensors are armed to trigger an alarm.

BRIEF SUMMARY

According to an embodiment of the disclosed subject matter, a method of controlling a security system of a premises includes capturing data, over a period of time, with a plurality of network connected sensors installed in or around the premises, storing the data in an electronic storage device, and arming two or more sensors in the security system in an order determined based on a history of detected activity in the premises as indicated by the stored data.

According to an embodiment of the disclosed subject matter, a security system includes a plurality of sensors installed at a premises to capture data from an environment in or around the premises, a memory configured to store data captured spanning at least a first period of time, and a processor configured to arm the plurality of sensors in an order determined based on a history of detected activity in the premises as indicated by the stored data.

According to an embodiment of the disclose subject matter, a method of controlling a security system of a premises includes capturing data, over a period of time, with a plurality of sensors installed in or around the premises, storing the data in an electronic storage device, determining, for each of the plurality of sensors, a time value ΔT that represents an amount of time that transpires between the security system being switched to an arming phase and a last detected event for the sensor, determining, for each of the plurality of sensors, a respective arm time based on the corresponding time value ΔT, and arming the plurality of sensors during the arming phase in an order determined based on the arm times.

According to an embodiment of the disclosed subject matter, means for capturing data, over a period of time, with a plurality of network connected sensors installed in or around the premises, storing the data in an electronic storage device, and arming two or more sensors in the security system in an order determined based on a history of detected activity in the premises as indicated by the stored data are provided.

According to an embodiment of the disclosed subject matter, means for controlling a security system of a premises includes capturing data, over a period of time, with a plurality of sensors installed in or around the premises, storing the data in an electronic storage device, determining, for each of the plurality of sensors, a time value ΔT that represents an amount of time that transpires between the security system being switched to an arming phase and a last detected event for the sensor, determining, for each of the plurality of sensors, a respective arm time based on the corresponding time value ΔT, and arming the plurality of sensors during the arming phase in an order determined based on the arm times are provided.

Additional features, advantages, and embodiments of the disclosed subject matter may be set forth or apparent from consideration of the following detailed description, drawings, and claims. Moreover, it is to be understood that both the foregoing summary and the following detailed description are illustrative and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate embodiments of the disclosed subject matter and together with the detailed description serve to explain the principles of embodiments of the disclosed subject matter. No attempt is made to show structural details in more detail than may be necessary for a fundamental understanding of the disclosed subject matter and various ways in which it may be practiced.

FIG. 6A shows an example data log according to an embodiment of the disclosed subject matter.

FIG. 6B shows another example data log according to an embodiment of the disclosed subject matter.

FIG. 7A shows an example sensor arm times database according to an embodiment of the disclosed subject matter.

FIG. 7B shows another example sensor arm times database according to an embodiment of the disclosed subject matter.

DETAILED DESCRIPTION

Figure 1:
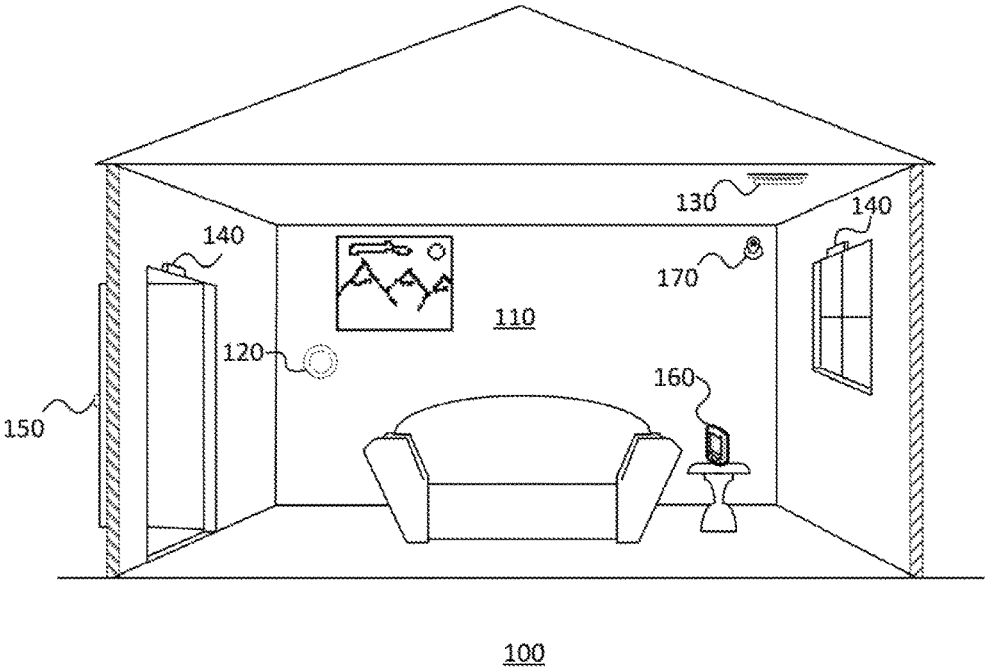
FIG. 1 shows an example premises management system according to an embodiment of the disclosed subject matter.

Various aspects or features of this disclosure are described with reference to the drawings, wherein like reference numerals are used to refer to like elements throughout. In this specification, numerous details are set forth in order to provide a thorough understanding of this disclosure. It should be understood, however, that certain aspects of disclosed subject matter may be practiced without these specific details, or with other methods, components, materials, etc. In other instances, well-known structures and devices are shown in block diagram form to facilitate describing the subject disclosure.

The disclosed subject matter relates to a smart security system that may dynamically and automatically "learn" to adjust an arming order and/or arming times for sensors in the security system to provide customized and improved security for the premises.

In a conventional security system, when a user instructs the system to enter an AWAY mode the system will enter an "arming" phase and give the user an exit allowance time, e.g., 45 seconds, to exit the premises before arming the sensors. During the arming phase, the sensors are unarmed, meaning an activity detected by the sensors will not trigger an alarm. Therefore, when the user exits prior to the expiration of the exit allowance time, the premises remains vulnerable for the remainder of the arming phase. An intrusion at a different entrance to the premises will not trigger an alarm.

The disclosed smart security system may determine a customized order and timing for arming sensors in the premises based on current data obtained by sensors, historical data obtained by sensors, other input data, and additional factors as will be described below. The disclosed smart security system may store data that has been captured by sensors and analyze the data to extract information about the environment, such as temperature, sound, lighting, presence/absence of a person/pet, motion, etc. Stored data may be time-logged and may indicate changes in the environment that serve as a recordation of physical events, such as entry, exit, through-movement, etc., or changes in the structure of the premises such as a door opening, a window closing, etc., or possibly various types of false alerts.

To determine the customized order and timing for arming sensors the disclosed smart security system may also share data with and receive data from other systems installed at the premises or accessible through a network, e.g., the Internet or cloud-based services. For illustrative purposes and to demonstrate example coordination and communications among different types of systems, the disclosed smart security system will be described below as part of a smart home network environment, which will be referred to generically as a "premises management system."

A premises management system as described herein may include a plurality of electrical and/or mechanical components, including intelligent, sensing, network-connected devices that communicate with each other and/or may communicate with a central server or a cloud-computing system to provide any of a variety of security and/or environment management objectives in a home, office, building or the like. Such objectives will collectively be referred to as "premises management," and may include, for example, managing alarms, notifying third parties of alarm situations, managing door locks, monitoring the premises, as well as managing temperature, managing lawn sprinklers, controlling lights, controlling media, etc.

A premises management system may include multiple systems or subsystems to manage different aspects of premises management. For example, the disclosed smart security system may manage security, while a smart home environment subsystem may handle aspects such as light, lawn watering and automated appliances, and an HVAC subsystem may handle temperature adjustments. Each subsystem may include devices, such as sensors, that obtain information about the environment.

The individual hardware components of the premises management system that are used to monitor and affect the premises in order to carry out premises management in general will hereinafter be referred to as "premises management devices." Premises management devices may include multiple physical hardware and firmware configurations, along with circuitry hardware (e.g., processors, memory, etc.), firmware, and software programming that are capable of carrying out the objectives and functions of the premises management system. The premises management devices may be controlled by a "brain" component, as will be described further below, which may be implemented in a controller device or in one or more of the premises management devices.

Turning now to a more detailed discussion in conjunction with the attached figures, FIG. 1 shows an example premises management system 100 that may include the disclosed smart security system. The system 100 may be installed within a premises 110. The system may also include multiple types of premises management devices, such as one or more intelligent, multi-sensing, network-connected thermostats 120, one or more intelligent, multi-sensing, network-connected hazard detection units 130, one or more intelligent, multi-sensing, network-connected entry detection units 140, one or more network-connected door handles (or door locks) 150, one or more intelligent, multi-sensing, network-connected controller devices 160, and one or more intelligent, multi-sensing, network-connected camera devices 170. Data captured by any of these or other devices may be used by the disclosed smart security system.

The premises management system 100 may be configured to operate as a learning, evolving ecosystem of interconnected devices. New premises management devices may be added, for example, to introduce new functionality, expand existing functionality, or expand a spatial range of coverage of the system. Furthermore, existing premises management devices may be replaced or removed without causing a failure of the system 100. Such removal may encompass intentional or unintentional removal of components from the system 100 by an authorized user, as well as removal by malfunction (e.g., loss of power, destruction by intruder, etc.). Due to the dynamic nature of the system 100, the overall capability, functionality and objectives of the system 100 may change as the constitution and configuration of the system 100 change. The types of data that may be used by the disclosed smart security system may also correspondingly change. For example, data that indicates environmental sound may be available in one configuration while data that indicates environmental temperature may be available in another configuration.

In order to avoid contention and race conditions among interconnected devices, the disclosed smart security system and the handling of certain system level decisions may be centralized in a "brain" component. The brain component may coordinate decision making across subsystems, the entire system 100, or a designated portion thereof. The brain component is a system element at which, for example, sensor/detector states converge, user interaction is interpreted, sensor data is received, subsystems are coordinated, and decisions are made concerning the state, mode, or actions of the system 100. Hereinafter, the system 100 brain component will be referred to as the "primary system processor." The primary system processor may be implemented, for example, in the controller device 160, via software executed or hard coded in a single device, or in a "virtual" configuration, distributed among one or more external servers or one or more premises management devices within the system. The virtual configuration may use computational load sharing, time division, shared storage, and other techniques to handle the primary system processor functions.

The primary system processor may be configured to implement the disclosed smart security system and to execute software to control and/or interact with the other subsystems and components of the premises management system 100. Furthermore, the primary system processor may be communicatively connected to control, receive data from, and transmit data to premises management devices within the system 100 as well as to receive data from and transmit data to devices/systems external to the system 100, such as third party servers, cloud servers, mobile devices, and the like.

Premises management devices (e.g., 120-150, 170) may include one or more sensors. In general, a "sensor" may refer to any device that can obtain data that provides an indication of a state or condition of its local environment. Such data may be stored or accessed by other devices and/or systems/subsystems. Sensor data may serve as the basis for information determined about the sensor's environment and as the basis for determining an arming order and/or arming timing for sensors in the smart security system.

Any premises management device that can capture data from the environment can be used as a data source for the disclosed smart security system. A brief description of sensors that can function as data sources that may be included in the system 100 follows.

The examples provided below are not intended to be limiting but are merely provided as illustrative subjects to help facilitate describing the subject matter of the present disclosure. It would be impractical and inefficient to list and describe every type of possible data source. It should be understood that deployment of types of sensors that are not specifically described herein will be within the capability of one with ordinary skill in the art.

Sensors may be described by the type of information they collect. In this nomenclature sensor types may include, for example, motion, smoke, carbon monoxide, proximity, temperature, time, physical orientation, position, acceleration, location, entry, presence, pressure, light, sound, and the like. A sensor also may be described in terms of the particular physical device that obtains the environmental data. For example, an accelerometer may obtain acceleration data, and thus may be used as a general motion sensor and/or an acceleration sensor. A sensor also may be described in terms of the specific hardware components used to implement the sensor. For example, a temperature sensor may include a thermistor, thermocouple, resistance temperature detector, integrated circuit temperature detector, or combination thereof.

A sensor further may be described in terms of a function or functions the sensor performs within the system 100. For example, a sensor may be described as a security sensor when it is used to determine security events, such as entry or exit through a door.

A sensor may serve different functions at the same time or at different times. For example, system 100 may use data from a motion sensor to determine the occurrence of an event, e.g., "individual entered room," or to determine how to control lighting in a room when an individual is present, or use the data as a factor to change a mode of the smart security system on the basis of unexpected movement when no authorized party is detected to be present.

In some cases, a sensor may operate to gather data for multiple types of information sequentially or concurrently. For example, a temperature sensor may be used to detect a change in atmospheric temperature as well as to detect the presence of a person or animal. A sensor also may operate in different modes (e.g., different sensitivity or threshold settings) at the same or different times. For example, a sensor may be configured to operate in one mode during the day and another mode at night.

Multiple sensors may be arranged in a single physical housing, such as where a single device includes movement, temperature, magnetic, and/or other sensors. Such a housing may still be generally referred to as a "sensor" or premises management device.

Figure 2:
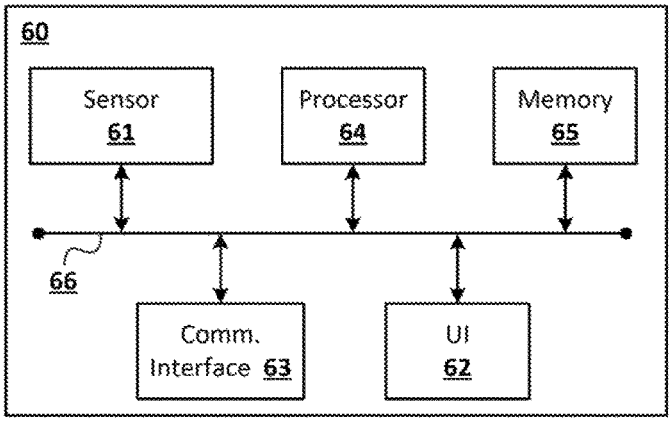
FIG. 2 shows an example premises management device according to an embodiment of the disclosed subject matter.

FIG. 2 shows an example premises management device 60 including a processor 64, a memory 65, a user interface 62, a communications interface 63, an internal bus 66, and a sensor 61. A person of ordinary skill in the art would appreciate that components of the premises management device 60 described herein can include electrical circuit(s) that are not illustrated, including components and circuitry elements of sufficient function in order to implement the device as required by embodiments of the subject disclosure. Furthermore, it can be appreciated that many of the various components listed above can be implemented on one or more integrated circuit (IC) chips. For example, a set of components can be implemented in a single IC chip, or one or more components may be fabricated or implemented on separate IC chips.

The sensor 61 may be an environmental sensor, such as a temperature sensor, smoke sensor, carbon monoxide sensor, motion sensor, accelerometer, proximity sensor, passive infrared (PIR) sensor, magnetic field sensor, radio frequency (RF) sensor, light sensor, humidity sensor, pressure sensor, microphone, imager, camera, compass or any other type of sensor that captures data or provides a type of information about the environment in which the premises management device 60 is located.

The processor 64 may be a central processing unit (CPU) or other type of processor chip, or circuit. The processor 64 may be communicably connected to the other components of the premises management device 60, for example, to receive, transmit and analyze data captured by the sensor 61, transmit messages, packets, or instructions that control operation of other components of the premises management device 60 and/or external devices, and process communication transmissions between the premises management device 60 and other devices. The processor 64 may execute instructions and/or computer executable components stored on the memory 65. Such computer executable components may include, for example, a primary function component to control a primary function of the premises management device 60 related to managing a premises, a communication component configured to locate and communicate with other compatible premises management devices, and a computational component configured to process system related tasks.

The memory 65 or another memory device in the premises management device 60 may store computer executable components and also be communicably connected to receive and store environmental data captured by the sensor 61. A communication interface 63 may function to transmit and receive data using a wireless protocol, such as a WiFi, Thread, other wireless interfaces, Ethernet, other local network interfaces, Bluetooth®, other radio interfaces, or the like, and may facilitate transmission and receipt of data by the premises management device 60 to and from other devices.

The user interface (UI) 62 may provide information and/or receive input from a user of system 100. The UI 62 may include, for example, a speaker to output an audible sound when an event is detected by the premises management device 60. Alternatively, or in addition, the UI 62 may include a light to be activated when an event is detected by the premises management device 60. The user interface may be relatively minimal, such as a liquid crystal display (LCD), light-emitting diode (LED) display, an LED or limited-output display, or it may be a full-featured interface such as, for example, a touchscreen, touchpad, keypad, or selection wheel with a click-button mechanism to enter input.

Internal components of the premises management device 60 may communicate via the internal bus 66 or other mechanisms, as will be readily understood by one of skill in the art. One or more components may be implemented in a single physical arrangement, such as where multiple components are implemented on a single integrated circuit. Premises management devices 60 as disclosed herein may include other components, and/or may not include all of the illustrative components shown.

As previously mentioned, sensor 61 captures data about the environment in or around the device 60, and at least some of the data may be translated into information that may be used by the disclosed smart security system to automatically determine an arming order and/or arming timing of security sensors. Through the bus 66 and/or communication interface 63, arming commands and other functions may be transmitted to or accessible by other components or subsystems of the premises management system 100.

Figure 3:
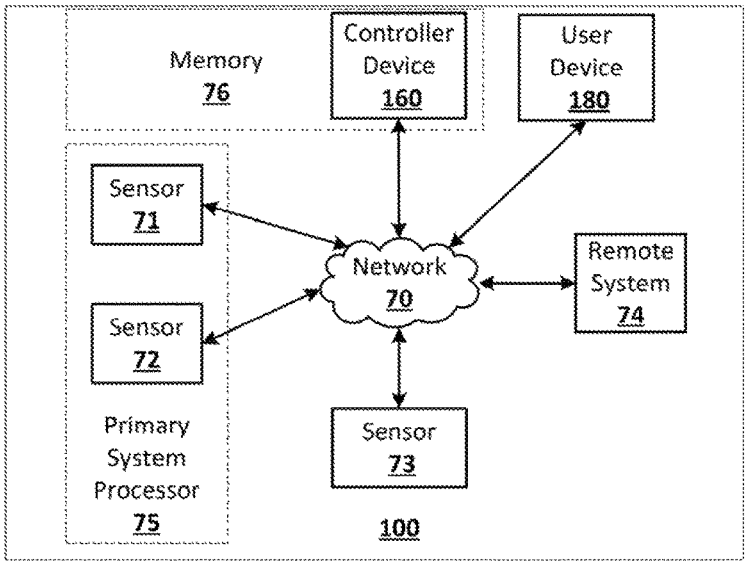
FIG. 3 shows a diagram example of a premises management system which may include an embodiment of the smart security system according to an embodiment of the disclosed subject matter.

FIG. 3 shows a diagram example of a premises management system 100 which may include an embodiment of the smart security system as disclosed herein. System 100 may be implemented over any suitable wired and/or wireless communication networks. One or more premises management devices, i.e., sensors 71, 72, 73, and one or more controller devices 160 (e.g., controller device 160 as shown in FIG. 1) may communicate via a local network 70, such as a WiFi or other suitable network, with each other. The network 70 may include a mesh-type network such as Thread, which provides network architecture and/or protocols for devices to communicate with one another. A user may interact with the premises management system 100, for example, using a user device 180, such as a computer, laptop, tablet, mobile phone, watch, wearable technology, mobile computing device, or using the controller device 160.

In the diagram of FIG. 3 a primary system processor 75 is shown implemented in a distributed configuration over sensors 71 and 72, and a memory 76 is shown implemented in controller device 160. However, the controller device 160 and/or any one or more of the sensors 71, 72, 73, may be configured to implement the primary system processor 75 and memory 76 or any other storage component required to store data and/or applications accessible by the primary system processor 75. The primary system processor 75 may implement the disclosed smart security system and may receive, aggregate, analyze, and/or share information received from the sensors 71, 72, 73, and the controller device 160. Furthermore, a portion or percentage of the primary system processor 75 and/or memory 76 may be implemented in a remote system 74, such as a cloud-based reporting and/or analysis system.

The premises management system 100 shown in FIG. 3 may be a part of a smart-home environment which may include a structure, such as a house, apartment, office building, garage, factory, mobile home, or the like. The system 100 can control and/or be coupled to devices and systems inside or outside of the structure. One or more of the sensors 71, 72 may be located inside the structure or outside the structure at one or more distances from the structure (e.g., sensors 71, 72 may be disposed at points along a land perimeter on which the structure is located, such as a fence or the like).

Sensors 71, 72, 73 may communicate with each other, the controller device 160 and the primary system processor 75 within a private, secure, local communication network that may be implemented wired or wirelessly, and/or a sensor-specific network through which sensors 71, 72, 73 may communicate with one another and/or with dedicated other devices. Alternatively, as shown in FIG. 3, one or more sensors 71, 72, 73 may communicate via a common local network 70, such as a Wi-Fi, Thread or other suitable network, with each other and/or with a controller 160 and primary system processor 75. Sensors 71, 72, 73 may also be configured to communicate directly with the remote system 74.

Sensors 71, 72, 73 may be implemented in a plurality of premises management devices, such as intelligent, multi-sensing, network-connected devices, that can integrate seamlessly with each other and/or with a central processing system or a cloud-computing system (e.g., primary system processor 75 and/or remote system 74). Such devices may include one or more intelligent, multi-sensing, network-connected thermostats (e.g., "smart thermostats"), one or more intelligent, network-connected, multi-sensing hazard detection units (e.g., "smart hazard detectors"), and one or more intelligent, multi-sensing, network-connected entry-way interface devices (e.g., "smart doorbells"). The smart hazard detectors, smart thermostats, and smart doorbells may be the sensors 71, 72, 73 shown in FIG. 3. These premises management devices may be used by the disclosed smart security system to obtain data used to determine an arming order and/or arming timing for sensors, but may also execute a separate, primary function.

For example, a smart thermostat may detect ambient climate characteristics (e.g., temperature and/or humidity) and may be used to control an HVAC system. In other words, ambient client characteristics may be detected by sensors 71, 72, 73 shown in FIG. 3, and the controller 160 may control the HVAC system (not shown) of the structure. However, a pattern of low temperature detected by sensors 71, 72, 73 over a period of time may also provide data that can serve as a basis for determining a timing for arming an area or zone of sensors, as will be described further below.

As another example, a smart hazard detector may detect light and the presence of a hazardous substance or a substance indicative of a hazardous substance (e.g., smoke, fire, or carbon monoxide). Light, smoke, fire, carbon monoxide, and/or other gasses may be detected by sensors 71, 72, 73 shown in FIG. 3, and the controller 160 may control an alarm system to provide a visual and/or audible alarm to the user of the smart-home environment based on data from sensor 71. However, data captured sensor 71 regarding light in a room over a period of time may also be used by the disclosed smart security as a basis for determining a timing for arming an area or zone of sensors.

As another example, one or more intelligent, multi-sensing, network-connected entry detectors (e.g., "smart entry detectors") may be specifically designed to function as part of the disclosed smart security subsystem. Such detectors may include one or more of the sensors 71, 72, 73 shown in FIG. 3. The smart entry detectors may be disposed at one or more windows, doors, and other entry points of the smart-home environment for detecting when a window, door, or other entry point is opened, broken, breached, and/or compromised. The smart entry detectors may generate a corresponding detection signal to be transmitted to the controller 160, primary system processor 75, and/or the remote system 74 when a window or door is opened, closed, breached, and/or compromised. The detection signal may provide data to the disclosed smart security system in order to serve as the basis for determining a timing for arming an area or zone of sensors.

Smart thermostats, smart hazard detectors, smart doorbells, smart entry detectors, and other premise management devices of the system 100 (e.g., as illustrated as sensors 71, 72, 73 of FIG. 3) can be communicatively connected to each other via the network 70, and to the controller 160, primary system processor 75, and/or remote system 74.

The disclosed smart security system may also include user specific features. Generally, users of the premises management system 100 may interact with the system 100 at varying permission and authorization levels. For example, users may have accounts of varying class with the system 100, each class having access to different features, such as controlling system settings, privacy settings, etc.

Users may be identified as account holders and/or verified for communication of control commands. For example, some or all of the users (e.g., individuals who live in a home) can register an electronic device, token, and/or key FOB with the premises management system 100 to enable to system 100 to identify the users and provide customized services, such as a geo-fence. Registration can be entered, for example, at a website, a system 100 interface (e.g., controller device 160), or a central server (e.g., the remote system 74) to bind the user and/or the electronic device to an account recognized by the system 100. Registered electronic devices may be permitted to control certain features of the system 100 and may be recognized in implementation of a geo-fence in the disclosed smart security system. The user may also use a registered electronic device to communicate with the disclosed smart security system or to control the network-connected smart devices when the user is located inside the premises.

Alternatively, or in addition to registering electronic devices, the premises management system 100 may make inferences about which individuals reside or work in the premises and are therefore users and which electronic devices are associated with those individuals. As such, the system 100 may "learn" who is a user (e.g., an inferred authorized user) and may incorporate such users into the geo-fence implementation or respond to communications from the electronic devices associated with those individuals, e.g., executing applications to control the network-connected smart devices of the system 100.

Once users (and their respective devices) have been registered or verified, the smart notification system may send notifications of events and status reports to the users via electronic messages, for example, sent via email, short message service (SMS), multimedia messaging service (MMS), unstructured supplementary service data (USSD), as well as any other type of digital messaging services and/or communication protocols.

Referring to FIG. 3, The controller device 160 may be implemented using a general- or special-purpose computing device. A general-purpose computing device running one or more applications, for example, may collect and analyze data from one or more sensors 71, 72, 73 installed in the premises and thereby function as controller device 160. In this case, the controller device 160 may be implemented using a computer, mobile computing device, mobile phone, tablet computer, laptop computer, personal data assistant, wearable technology, or the like. In another example, a special-purpose computing device may be configured with a dedicated set of functions and a housing with a dedicated interface for such functions. This type of controller device 160 may be optimized for certain functions and presentations, for example, a wall-mounted unit including an interface specially designed to receive user authentication to disarm an alarm or control settings of the disclosed smart security system.

The controller device 160 may function locally with respect to the sensors 71, 72, 73 with which it communicates and from which it obtains sensor data, such as in the case where it is positioned within a home that has a premises management system 100 installed therein. Alternatively or in addition, controller device 160 may be remote from the sensors 71, 72, 73, such as where the controller device 160 is implemented as a cloud-based remote system 74 that communicates with multiple sensors 71, 72, 73, which may be located at multiple locations and may be local or remote with respect to one another.

Figure 4:
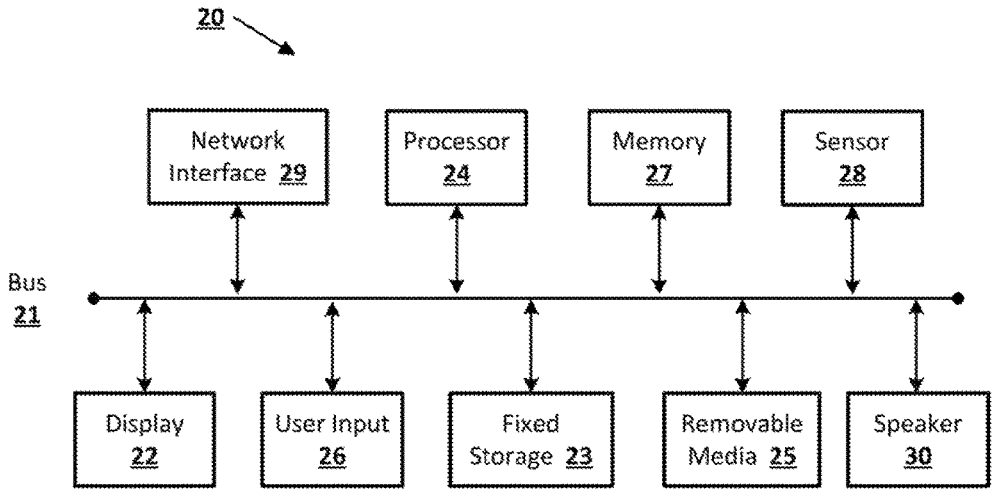
FIG. 4 shows an example computing device suitable for implementing a controller device according to an embodiment of the disclosed subject matter.

FIG. 4 shows an example computing device 20 suitable for implementing the controller device 160. The computing device 20 may include a bus 21 that interconnects major components of the computing device 20. Such components may include a central processor 24; a memory 27, such as Random Access Memory (RAM), Read Only Memory (ROM), flash RAM, or the like; a sensor 28, which may include one or more sensors as previously discussed herein; a user display 22, such as a display screen; a user input interface 26, which may include one or more user input devices such as a keyboard, mouse, keypad, touch pad, turn-wheel, and the like; a fixed storage 23 such as a hard drive, flash storage, and the like; a removable media component 25 operable to control and receive a solid-state memory device, an optical disk, a flash drive, and the like; a network interface 29 operable to communicate with one or more remote devices via a suitable network connection; and a speaker 30 to output an audible communication to the user. In some embodiments the user input interface 26 and the user display 22 may be combined, such as in the form of a touch screen.

The bus 21 allows data communication between the central processor 24 and one or more memory components 25, 27, which may include RAM, ROM, and other memory, as previously noted. Applications resident with the computing device 20 are generally stored on and accessed via a computer readable storage medium.

The fixed storage 23 may be integral with the computing device 20 or may be separate and accessed through other interfaces. The network interface 29 may provide a direct connection to the premises management system and/or a remote server via a wired or wireless connection. The network interface 29 may provide such connection using any suitable technique and protocol, as will be readily understood by one of skill in the art, including digital cellular telephone, WiFi, Thread, Bluetooth®, near-field, and the like. For example, the network interface 29 may allow the computing device 20 to communicate with other components of the premises management system, other computers via one or more local, wide-area, or other communication networks, as described in further detail herein.

Figure 5A:
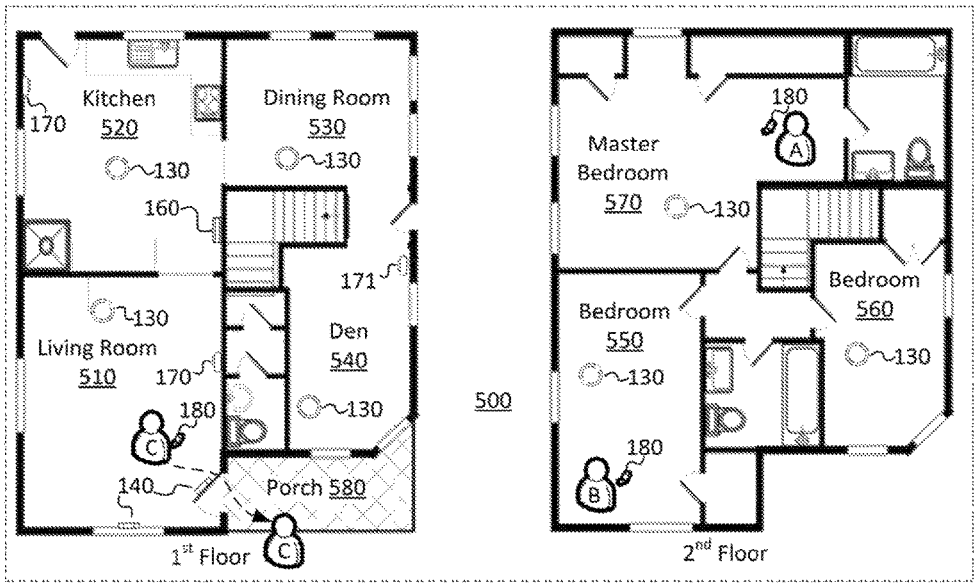
FIG. 5A shows a layout of a two-floor house 500 including a premises management system installed therein according to an embodiment of the disclosed subject matter.

FIG. 5A shows a layout of a two-floor house 500 including an example premises management system as described above installed therein. The house 500 includes a living room 510, kitchen 520, dining room 530, den 540, bedroom 550, bedroom 560, master bedroom 570, and porch 580. Authorized individuals A, B, and C are present within the house 500, each carrying a mobile phone 180.

A premises management system 100 installed in the house 500 includes an embodiment of the disclosed smart security system. Referring to FIGS. 1 and 5, the system 100 may include network-connected hazard detection units 130 installed throughout the house 500, network-connected entry detection units 140 installed at windows and doors throughout the house, a network-connected controller device 160, and network connected cameras 170. For simplicity and to avoid unnecessary clutter in the figure, only one window entry detection unit 140, one door entry detection unit 140, and two cameras 170 are illustrated, but it should be understood that entry detection units 140 may be installed at multiple windows and/or doors throughout the house 500, cameras 170 may be installed in other rooms and outside of the house 500, and that other premise management devices (e.g., smart thermostats, smart doorbells, motion detectors, light detectors etc.) as described above may be installed as part of the system 100.

Figure 5B:
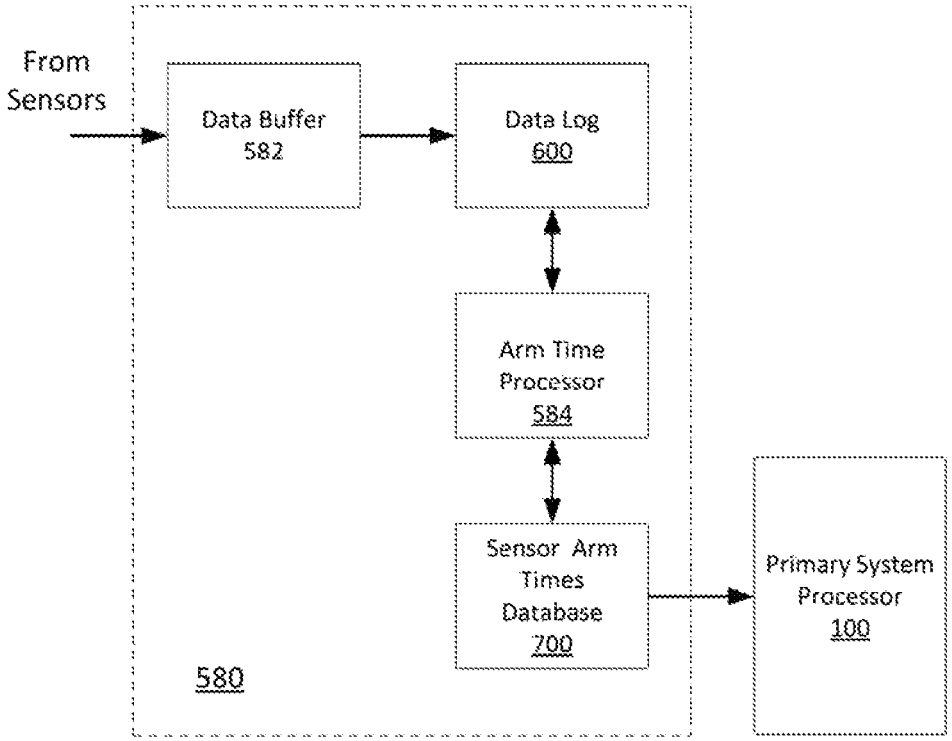
FIG. 5B shows a smart security system according to an embodiment of the disclosed subject matter.

FIG. 5B shows an embodiment of a smart security system 580 that may be implemented within the premises management system 100 (FIG. 1) installed in the premises 500. The smart security system 580 may include, among other components, a data buffer 582, a data log 600, an arm time processor 584, and a sensor arm times database 700. The smart security system 580 may be configured to store and analyze data captured by sensors on premises management devices 130, 140, 160, 170.

The data buffer 582 may receive and temporarily store data from sensors on an on-going basis. The data log 600 may selectively store data from the data buffer 582. For example, the data log 600 may store data according to a rule or algorithm that is applied based on an amount of storage space available in the system. An example rule may be to only store data triggered by certain types of events, to only store samples on a periodic basis, to only store data when there is a change in the data above a threshold amount, to only store data from select devices, or any combination of these or other rules that may reduce or classify the amount and/or type of data that is stored long term in the data log 600. Furthermore, the data log 600 may be configured to store data for a set period of time, e.g., one week, the last 30 days, the last 90 days, or the like.

The data storage rule and data storage period applied by the data log 600 may change, for example, based on a command or setting, based on available storage capacity, or based on a given mode of the smart security system 580. For example, if the smart security system 580 is configured to be implemented by premises management devices in a dynamic premises management system 100, then the data storage capacity may change when new devices are added or removed from the system, and the data storage rule may be automatically adjusted accordingly.

In one embodiment, data log 600 may be configured to store, per sensor, one or more values that indicate last detected event times during a system arming phase. As previously described, after a user sets the system to AWAY, the system will enter an arming phase that will last, by default, for the full duration of an exit allowance time, e.g., 45 seconds. The user(s) will then proceed to exit the premises. During this exit, one or more sensors may detect the movement of the user(s) throughout the premises.

For example, referring to FIG. 5A, at time $T_0$ user C sets the system to AWAY mode at controller 160, then proceeds to pass through the living room 510 and exit out of the front door. Sensors, such as camera 170 and entry detector 140, detect user C passing by during the exit. The data log 600 may store data indicating how long after time $T_0$ each sensor detected an event.

FIG. 6A shows an example data log 600. Referring to FIGS. 5A and 6A, when user C sets the system to AWAY mode at controller 160 and then walks toward the front door, the kitchen thermostat 130, which may also include a microphone, may detect a sound. Eventually user C will have walked too far away from the sensor to be detected. When this happens, the data log 600 stores data indicating the last detected event and the amount of time ΔT that elapsed from the initiation of the arming phase and the event. A first entry 610 of "2" indicates that the last detected sound by thermostat 130 occurred 2 seconds after the initiation of the arming phase.

The data log 600 may include similar entries for other sensors that detected the exit of user U, such as living room camera 170 and front door entry detector 140. In addition, the data log 600 may include entries for sensors that did not detect any event during the arming phase, for example, such as the den camera 171.

The arm time processor 584 may determine an "arm time" per sensor based on the data stored in the data log 600. Here, "arm time" refers to an amount of time that a sensor will remain inactive during the arming phase. The arm time processor 584 may store the sensor arm times in a database 700. If a sensor is assigned an arm time that is less than the exit allowance time, then the sensor may be armed during the arming phase.

Several different examples of how the disclosed smart security system may determine sensor arm times and/or an exit allowance time will now be provided. It should be understood that the disclosed subject matter is not limited to these specific examples, rather, these examples are provided to facilitate understanding of the system. A person of ordinary skill in the art may implement methods within the scope of this disclosure that are not included here based on the principles disclosed herein.

Referring to FIG. 6A, over a period of time number of exits occur and the data log 600 may include a plurality of entries for one or more sensors. For example, the living room camera 170 includes seven data entries. In one embodiment, the arm time processor 584 may determine arm times for each sensor based on a maximum last event time ΔT+a buffer amount. The buffer amount may be preset or may be determined by a user setting as to how strict or conservative the user prefers the system to operate. For the living room camera 170, with a buffer value of 5 seconds, the arm time is calculated as follows: (ΔT)+(buffer)=6+5=11 second arm time.

FIG. 7A shows an example sensor arm times database 700. For each of a plurality of sensors, the arm time processor 584 may determine and store an arm time. The arm time processor 584 may further determine an adjusted exit allowance time based on the calculated arm times. For example, the exit allowance time may be determined to be the longest arm time plus a buffer amount. In the example database 700, the exit allowance time may be determined as: (longest arm time)+(buffer amount)=16 seconds+15 seconds=31 second exit allowance. The buffer amount may be adjusted, for example, as a user setting in accordance with a user's preference to balance comfort level and security.

In some instances there may be sensors that, for a given period of time, do not detect any activity during the arming phase. It may be the case that no user passes through certain section of the premises while exiting. FIG. 6A shows that over the time period represented in the data log 600, the den camera 171 did not detect an event during an arming phase. As shown in FIG. 7A, the arm time processor 584 may accordingly record an arm time of zero for den camera 171.

The sensor arm times may be used in different ways, for example, depending on the capabilities of the current system configuration, depending upon the amount of data stored in the data log 600 or depending on user settings, etc. For example, in a system configuration that has relatively low processing and/or storage capabilities, sensors may be categorized into sets (e.g., basement, first floor, interior, perimeter, etc.), with each set being assigned an arm time. For example, a set may be assigned an arm time based on the highest ΔT value for any sensor in the set. In one embodiment, the sets may include interior sensors and perimeter sensors.

Interior sensors may include sensors that detect events and activities that occur within the premises, such as cameras, motion detectors, or thermostats. Perimeter sensors may include sensors that detect events and activities that occur at a perimeter of the premises, such as entry detectors installed at windows and doors.

In this embodiment, the perimeter set of sensors may be assigned a relatively low, default arm time, for example, zero seconds. This ensures that certain potential entry paths to the premises are protected more quickly than in a conventional security system.

The interior set of sensors may be assigned an arm time based on the highest arm time ΔT in the sensor arm time database 700, for example, 16 seconds, as shown in FIG. 7. Furthermore, any sensor in the interior set of sensors that has an arm time less than or equal to the exterior set arm time may be shifted over to the exterior set. For example, the den camera 171 in FIG. 7 may be shifted to the exterior set and armed in zero seconds, while the remaining interior set of sensors will be armed at 16 seconds. This ensures that the interior will be protected against intrusion at a rate faster than in the conventional security system.

In one embodiment, for example, in a configuration with sufficient processing and/or storage capabilities, each individual sensor may receive a designated arm time countdown when the disclosed smart security system is set to AWAY mode and enters an arming phase. In this manner the sensors will arm in an order and timing based on their respective exit arm times. At a maximum, however, all sensors will be armed upon the expiration of the exit allowance time. Accordingly, each sensor that has an arm time greater than zero and less than the default exit allowance time will be armed at a timing based on its arm time as stored in database 700. For example, the kitchen thermostat 130 may arm when 9 seconds have transpired, the living room camera may arm when 11 seconds have transpired, and so on. This embodiment further decreases the amount of time that the premises remains vulnerable and more tightly secures and customizes security of the premises to match the actual use of the premises. This embodiment may be further improved to include arming a perimeter set of sensors at a default low time, such as zero seconds, regardless of their arm time as determined in the database 700.

In one embodiment, further improvements may be provided by arming the sensors upon detection that all users have exited the premises. This may result in the amount of time that the system is not fully armed being reduced further. The disclosed smart security system may detect that users have exited, for example, by using cameras or a geo-fence signal. As shown in FIG. 5A, users A, B and C have cell phones 180. After all of the cell phones 180 have been detected to have exited the premises, a signal may be sent to the smart security system to arm all remaining sensors that have not yet been armed. Alternatively, cameras may be used to detect when all users have exited the premises.

In order to provide accurate and dynamic service, the arm time processor 584 may be configured to update the sensor arm times database 700 periodically or upon the occurrence of an event. For example, the processor 584 may update the database 700 once per week, once per month, etc. In order to minimize false alarms and maintain a level of consistency for the users, the processor 584 may be configured to avoid changes that abruptly lower an arm time for a sensor or set of sensors.

FIG. 6B shows an example of the data log 600 at some time $T_1$ after the time $T_0$ of FIG. 6A. Notably, during this time period an individual was detected passing through the den during an exit, as indicated by the recorded last event time ΔT of 9 seconds for den camera 171. This event appears to be an outlier, i.e., a single anomalous occurrence that resulted in a chain of longer than normal times ΔT. In response, however the processor 584 may update the database 700 as shown in FIG. 7B. Thus, the system will take longer to arm either sensors or a set of sensors than it did prior to this event.

As time progresses, at some point in time $T_2$ the data log 600 will again resemble the times shown in FIG. 6A, which are the true normal for this premises. However, when the processor 584 updates the database 700 based on the $T_2$ normal data, the processor 584 may be restricted from lowering any sensor arm time greater than a predetermined amount, for example, 3 seconds. In this manner even though the data that indicated the anomaly is gone, the system will not abruptly cut down to a lower arm time. It may be the case that users got used to the longer arm time, and as a precaution a gradual step down in arm times mitigates against false alarms.

Conversely, in some circumstances the smart security system may increase the amount of time remaining in an exit allowance. Such circumstances may include, for example, when an exception has occurred or when a user continues to interact with the system during the arming phase.

An exception may occur when a component of the security system is not completely secure, not completely functional, or at risk of becoming non-functional, e.g., a window left open, a door left open, a sensor battery low, etc. The smart security system may notify the user of any existing exceptions when the user sets the system in AWAY mode.

The exception notifications may be provided audibly or in the form of a list displayed on the controller 160 interface. The list may include interface elements for scrolling through the exceptions or responding to exceptions, such as to instruct the system to ignore a given exception. This may occur, for example, if the user has several windows open and desires to leave them open and not be notified of their status as exceptions again for a given period of time, e.g., for the rest of the day. In the case of extended interaction with the controller 160 interface, for every input (swipe, keystroke, button press, audible command, etc.) the smart security system may increment the exit allowance time by a preset amount, e.g., ten seconds. Furthermore, the smart security system may similarly increment each of the sensor or sensor set arm times that are greater than zero. This feature allows for a more dynamic tracking of the arm time and exit allowance time to the events that are occurring in real time.

In addition, if the user decides to correct an exception, the smart security system can automatically increment the arm times and the exit allowance time accordingly by a set amount, e.g., thirty seconds. This feature allows the user to go directly and address the exception without needing to interact with the system and without being concerned about being caught in the premises when the system shifts from the arming phase to fully armed. For example, if the exception is an open window in the kitchen, the smart security system may notify the user of the exception and the user may directly go to the kitchen and close the window. When the smart security system detects that the window has been closed and the exception has been addressed, the exit allowance and arm times may be automatically incremented by thirty seconds.

Furthermore, the smart security system can adjust the exit allowance time based on user input. The smart security system can receive the user input via a controller user interface at by initiation of the user or of the system. The smart security system may be configured to request user input based on certain conditions of sequences of events. For example, if the system triggers an alarm during the exit allowance and the alarm turns out to be a false alarm (i.e., the exit allowance was short and the user was still home and immediately disarmed the system), an option could be presented to the user suggesting a longer exit allowance time or increasing the buffer amount used to calculate the exit allowance time. If the user chooses to accept the suggested change, then the new exit time or new buffer will be applicable during the next arming session and onwards.

Figure 8:
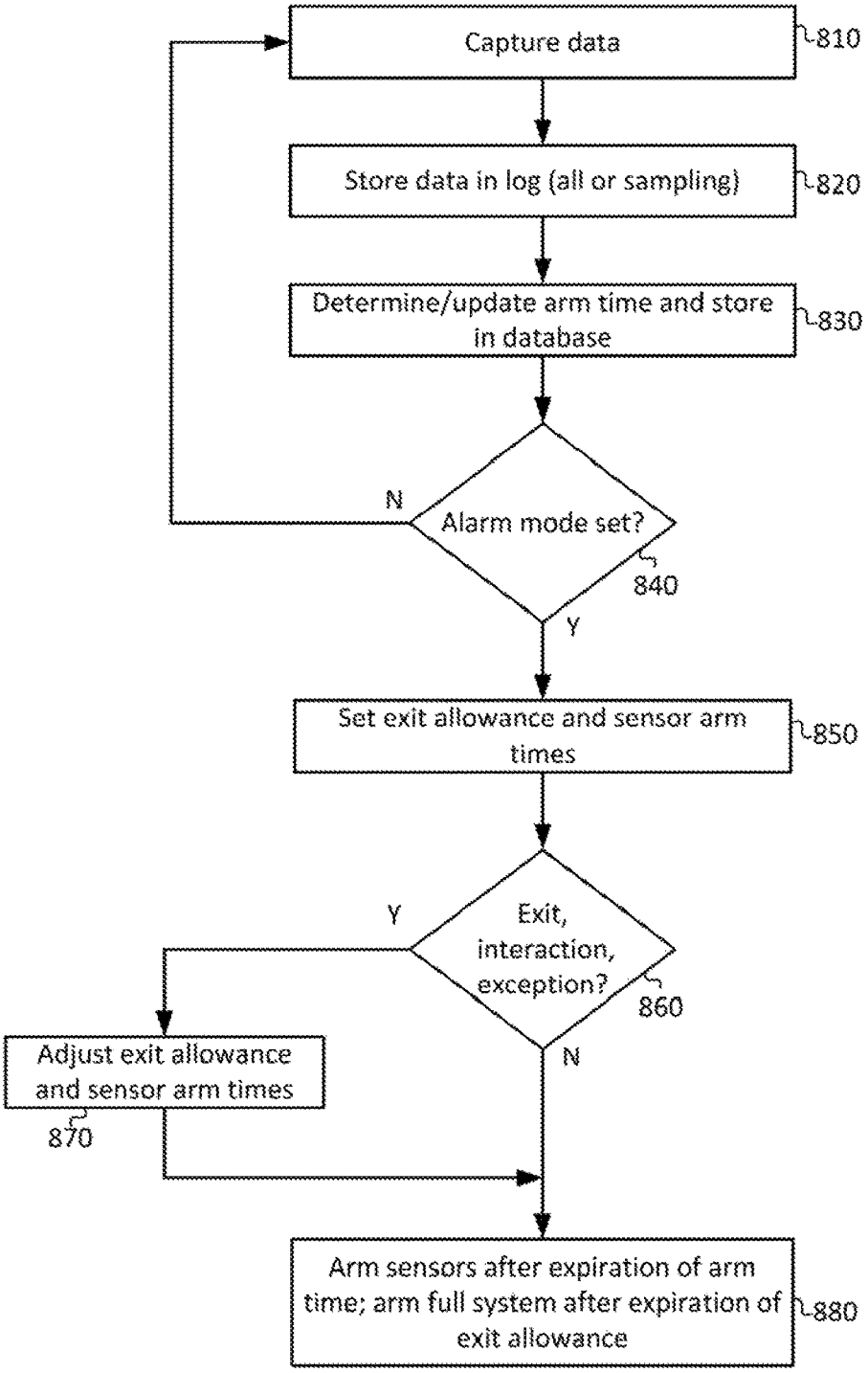
FIG. 8 shows a flowchart according to an embodiment of the disclosed subject matter.

FIG. 8 shows a flowchart of operations of the disclosed smart security system. At operation 810 a plurality of network-connected sensors capture data from the environment in and/or around the premises. The data capture may continue on an on-going basis and may include any type of measurable aspect of the environment (e.g., light, sound, motion, temperature, smoke, etc.). The captured data may be supplemented by additional data from other subsystems of the premises management system or by data from external sources such as cloud-based servers or services.

At operation 820 the data is stored in a data log. The data may be stored in a temporary buffer with a sampling of the data from the buffer being stored to the data log, or all data may be directly stored to the data log, depending on the capacity and capability of the overall system. The data stored in the data log may represent specific events and times. For example, the data log may store data that indicates a last event detected by one or more sensors after the disclosed smart security system is set to a certain mode, e.g., entering an arming phase when set to AWAY mode. The data may also indicate an amount of time $\Delta T$ that transpired between the initiation of the mode and the detection of the event. The data log may be configured to store the data for a set period of time, e.g., sixty days, or ninety days, etc.

At operation 830, a processor may analyze the data stored in the data log and determine one or more arm times for sensors in the disclosed smart security system based on the stored data. The processor may be configured to determine the arm times for individual sensors or for sets of sensors. For example, sensors could be assigned to sets such as interior sensors, perimeter sensors, or other categories, such as basement, first floor, second floor, rec room, garage, etc. The processor may also be configured to determine an arm time for an individual sensor based on the longest last event time $\Delta T$ for the sensor, for example: arm time=$\Delta T$+buffer amount. The processor may be configured to determine an arm time for a set of sensors based on the longest last event time $\Delta T$ for any sensor in the set. The processor also may be configured to determine an arm time for an individual sensor or a set of sensors to automatically be a certain low value, such as zero seconds. For example, all sensors in a perimeter set of sensors may be armed in zero seconds after the initiation of the arming phase.

The processor may be configured to store the determined arm time in a database. The processor may also be configured to periodically update arm times already stored in the database. When the processor updates an arm time, if a currently determined arm time is lower than the arm time stored in the database, the processor may be configured to reduce the stored arm time by no more than a predetermined amount, for example, five seconds.

At operation 840 the disclosed smart security system may be set to an alarm mode, such as AWAY. If the alarm mode is not set, then operations continue at operation 810. If the alarm mode is set, the processor proceeds to set the exit allowance time and the sensor arm time(s) at operation 850. The sensor arm times may be set per individual sensor or per set(s) of sensors, according to the arm times stored in the database.

At operation 860 the processor determines whether all users have exited or whether any exception occurs. If all users are detected to have exited, for example, based on a geo-fence signal or a camera signal, then the smart security system adjusts the arm times and exit allowance time to zero at operation 870. If instead the user continues to interact with the interface and/or if the user corrects any exception, at operation 870 the smart security system may adjust the remaining exit allowance time and arm times to increase an amount of time remaining.

At operation 870 the sensors and/or sets of sensors are armed in order after expiration of their arm times. In any event, all sensors are armed and the system is completely armed at least by the expiration of the exit allowance time.

In this manner, the disclosed smart security system may capture data that indicates a history of activity in a premises and, during an arming phase, arm sensors or sets of sensors in an order that is determined based on the history. Thus, the disclosed smart security system may improve the security of a premises by protecting areas of the home faster than a convention system. The disclosed smart security system may also provide improved responsiveness and decreased false alarms by adjusting sensor arm times and the exit allowance time based on events and/or activities detected during the arming phase.

In situations in which the systems discussed here collect personal information about users, or may make use of personal information, the users may be provided with an opportunity to control whether programs or features collect user information (e.g., information about a user's social network, social actions or activities, profession, a user's preferences, or a user's current location), or to control whether and/or how to receive content from the content server that may be more relevant to the user. In addition, certain data may be treated in one or more ways before it is stored or used, so that personally identifiable information is removed. For example, specific information about a user's residence may be treated so that no personally identifiable information can be determined for the user, or a user's geographic location may be generalized where location information is obtained (such as to a city, ZIP code, or state level), so that a particular location of a user cannot be determined. As another example, systems disclosed herein may allow a user to restrict the information collected by those systems to applications specific to the user, such as by disabling or limiting the extent to which such information is aggregated or used in analysis with other information from other users. Thus, the user may have control over how information is collected about the user and used by a system as disclosed herein.

Some portions of the detailed description have been presented in terms of algorithms and symbolic representations of operations on data bits within a computer memory. These algorithmic descriptions and representations are commonly used by those skilled in the data processing arts to most effectively convey the substance of their work to others skilled in the art. An algorithm is here and generally, conceived to be a self-consistent sequence of steps leading to a result. The steps are those requiring physical manipulations of physical quantities. Usually, though not necessarily, these quantities take the form of electrical or magnetic signals capable of being stored, transferred, combined, compared and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "receiving," "determining," "analyzing," "calculating," "identifying," "storing," "capturing," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Some portions of the disclosed smart security system have been described with respect to interaction between several components/blocks. A person of ordinary skill in the art would appreciate that such systems/circuits and components/blocks can include those components or specified sub-components, some of the specified components or sub-components, and/or additional components, according to various permutations and combinations of the foregoing. Sub-components can also be implemented as components communicatively coupled to other components rather than included within parent components (hierarchical). Additionally, it should be noted that one or more components may be combined into a single component providing aggregate functionality or divided into several separate sub-components, and any one or more middle layers, such as a management layer, may be provided to communicatively couple to such sub-components in order to provide integrated functionality. Any components described herein may also interact with one or more other components not specifically described herein but known by those of ordinary skill in the art.

Furthermore, while for purposes of simplicity of explanation some of the disclosed methodologies have been shown and described as a series of operations within the context of various block diagrams and flowcharts, it is to be understood and appreciated that embodiments of the disclosure are not limited by the order of operations, as some operations may occur in different orders and/or concurrently with other operations from that shown and described herein. For example, those skilled in the art will understand and appreciate that a methodology can alternatively be represented as a series of interrelated states or events, such as in a state diagram. Moreover, not all illustrated operations may be required to implement a methodology in accordance with the disclosed subject matter. Additionally, it is to be further appreciated that the methodologies disclosed hereinafter and throughout this disclosure are capable of being stored on an article of manufacture to facilitate transporting and transferring such methodologies to computers. The term article of manufacture, as used herein, is intended to encompass a computer program accessible from any computer-readable device or non-transitory storage media.

More generally, various embodiments of the presently disclosed subject matter may include or be embodied in the form of computer-implemented processes and apparatuses for practicing those processes. Embodiments also may be embodied in the form of a computer program product having computer program code containing instructions embodied in non-transitory and/or tangible media, such as hard drives, USB (universal serial bus) drives, or any other machine readable storage medium, such that when the computer program code is loaded into and executed by a computer, the computer becomes an apparatus for practicing embodiments of the disclosed subject matter. When implemented on a general-purpose microprocessor, the computer program code may configure the microprocessor to become a special-purpose device, such as by creation of specific logic circuits as specified by the instructions.

In some configurations, a set of computer-readable instructions stored on a computer-readable storage medium may be implemented by a general-purpose processor, which may transform the general-purpose processor or a device containing the general-purpose processor into a special-purpose device configured to implement or carry out the instructions. Embodiments may be implemented using hardware that may include a processor, such as a general purpose microprocessor and/or an Application Specific Integrated Circuit (ASIC) that embodies all or part of the techniques according to embodiments of the disclosed subject matter in hardware and/or firmware. The processor may be coupled to memory, such as RAM, ROM, flash memory, a hard disk or any other device capable of storing electronic information. The memory may store instructions adapted to be executed by the processor to perform the techniques according to embodiments of the disclosed subject matter.

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as may be suited to the particular use contemplated.

The invention claimed is:

1. A method of controlling a security system of a premises, comprising:

receiving a user input at a time ($T_0$) setting the security system into an alarm mode;

arming a first set of sensors in the security system when a first arm time after $T_0$ expires;

arming a second set of sensors in the security system when a second arm time after $T_0$ expires, the second arm time being longer than the first arm time, where "arm time" refers to an amount of time during which a sensor will not trigger an alarm after the security system has been set into the alarm mode.

2. The method of claim 1, wherein the first set of sensors are disposed at perimeter windows and/or entry points of the premises, and the second set of sensors are disposed at interior positions of the premises.

3. The method of claim 1, wherein the first arm time is zero seconds.

4. The method of claim 1, further comprising:

detecting that all users have exited the premises; and arming the first set of sensors and the second set of sensors upon the detection, regardless of whether the first arm time or second arm time has expired.

5. The method of claim 4, wherein the detection is based on one or more geo-fence signals from one or more user devices.

6. The method of claim 4, wherein the detection is based on data obtained from one or more cameras installed at the premises.

7. The method of claim 1, further comprising:

determining an amount of time $\Delta T$ that expires between $T_0$ and a last event detected by any sensor in the first or second set of sensors;

storing the time $\Delta T$ in a data log; and setting the second arm time to an amount=$\Delta T+X_T$, where $X_T$ is a predetermined buffer value.

8. A security system comprising:

a plurality of sensors installed at a premises to capture data from an environment in or around the premises;

a memory configured to store captured data;

an interface configured to receive a user input setting the security system into an alarm mode at a time ($T_0$); and a processor configured to arm a first set of sensors in the plurality of sensors when a first arm time after $T_0$ expires, and to arm a second set of sensors in the plurality of sensors when a second arm time after $T_0$ expires, the second arm time being longer than the first arm time, wherein "arm time" refers to an amount of time during which a sensor will not trigger an alarm after the security system has been set into the alarm mode.

9. The security system of claim 8, wherein the first set of sensors are disposed at perimeter windows and/or entry points of the premises, and the second set of sensors are disposed at interior positions of the premises.

10. The security system of claim 8, wherein the first arm time is zero seconds.

11. The security system of claim 8, wherein the processor is further configured to:

detect that all users have exited the premises based on one or more signals; and arm the first set of sensors and the second set of sensors upon the detection, regardless of whether the first arm time or second arm time has expired.

12. The security system of claim 11, wherein the processor detects that all users have exited the premises based on one or more geo-fence signals from one or more user devices.

13. The security system of claim 11, wherein the processor detects that all users have exited the premises based on data signals from one or more cameras installed at the premises.

14. The security system of claim 8, the processor is further configured to:

determine an amount of time $\Delta T$ that expires between $T_0$ and a last event detected by any sensor in the first or second set of sensors;

store the time $\Delta T$ in a data log in the memory; and set the second arm time to an amount=$\Delta T+X_T$, where $X_T$ is a predetermined buffer value.

* * * * *